United States Patent [19]

Miller

[11] 3,968,784

[45] July 13, 1976

[54] SPRING TYPE PROJECTILE PROJECTING DEVICE

[75] Inventor: Larry E. Miller, Bryan, Ohio

[73] Assignee: The Ohio Art Company, Bryan, Ohio

[22] Filed: Feb. 10, 1975

[21] Appl. No.: 548,263

[52] U.S. Cl. ..... 124/27; 124/31; 124/41 R; 273/106.5 A

[51] Int. Cl.[2] ..... F41B 7/00

[58] Field of Search ..... 124/27, 28, 29, 41, 124/31, 26; 273/106.5 A

[56] References Cited

UNITED STATES PATENTS

| | | | |
|---|---|---|---|
| 2,462,248 | 2/1949 | Zbar | 124/26 |
| 2,817,329 | 12/1957 | Wehrfritz | 124/27 |
| 2,888,004 | 5/1959 | Steiner | 124/27 |
| 3,035,564 | 5/1962 | Hellman | 124/26 |
| 3,059,630 | 10/1962 | Oreskey | 124/27 |
| 3,801,102 | 4/1974 | Lohr et al. | 273/106.5 A |

*Primary Examiner*—Richard C. Pinkham
*Assistant Examiner*—William R. Browne

[57] ABSTRACT

A plastic pistol shaped toy dart gun having a barrel with a non-circular muzzle opening for a suction cup ended dart shaft having a cooperating cross section with that opening; which barrel houses a helical compressible dart ejecting spring and has extending along the side of the barrel, the longer leg of an L-shaped trigger pivoted centrally of this leg. This trigger has a hook at the outer end of this longer leg for engaging a notch in the shaft of the dart for cocking the gun, and at the inner end of the longer leg a spring side engagable portion for insuring engagement of the hook when the proper dart is properly inserted into the gun. The barrel also contains opposite this spring engagable portion on the trigger, a spring deflector cam to urge the compressed spring against this engagable portion of the trigger for further insuring engagement of the hook into the notch in the dart's shaft for cocking the gun.

8 Claims, 5 Drawing Figures

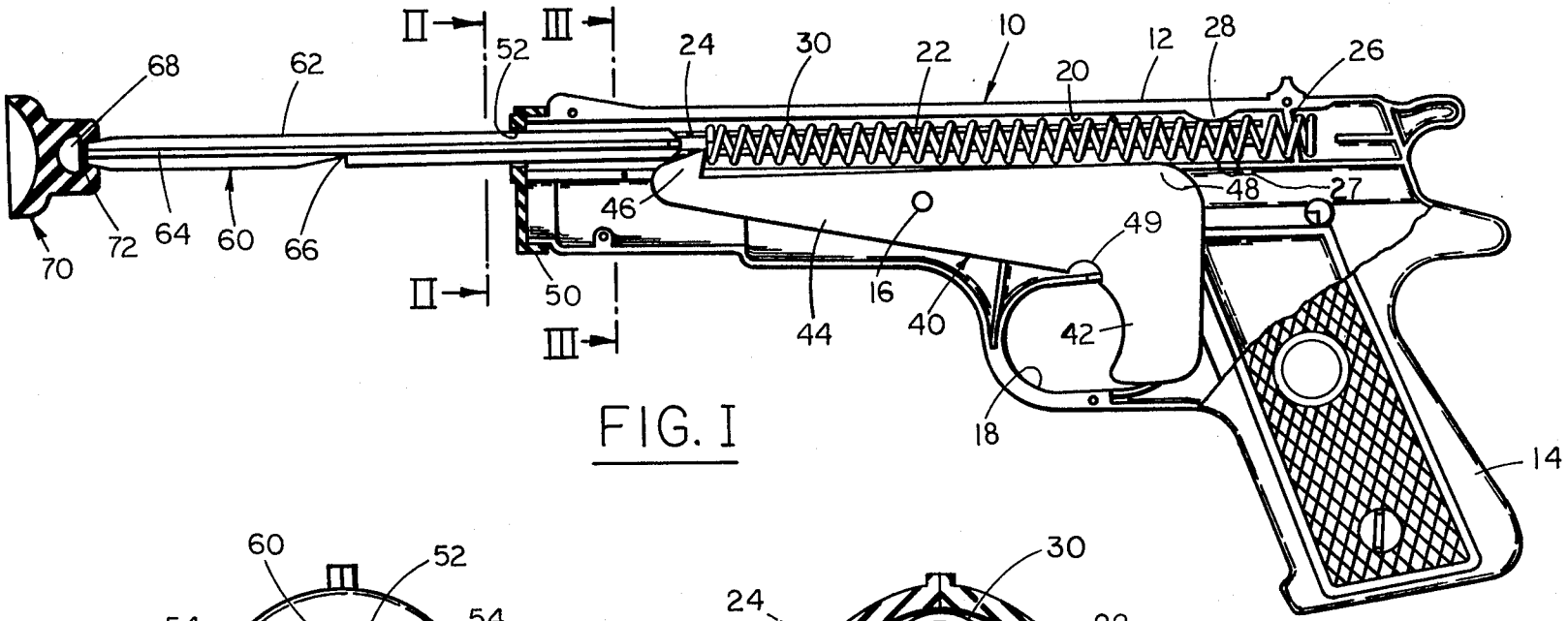
FIG. I
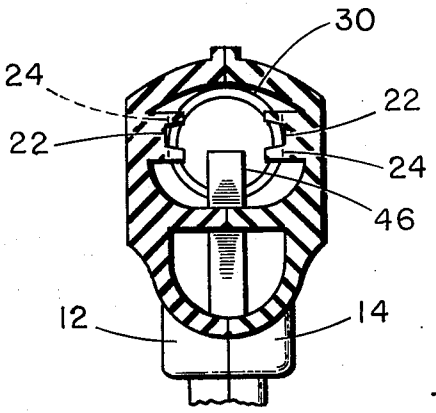
FIG. III
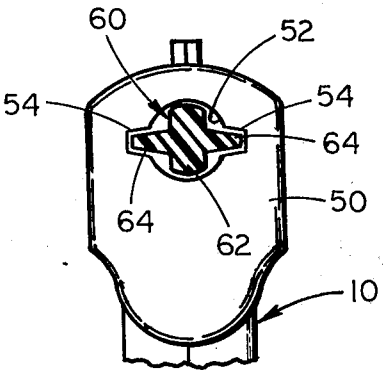
FIG. II

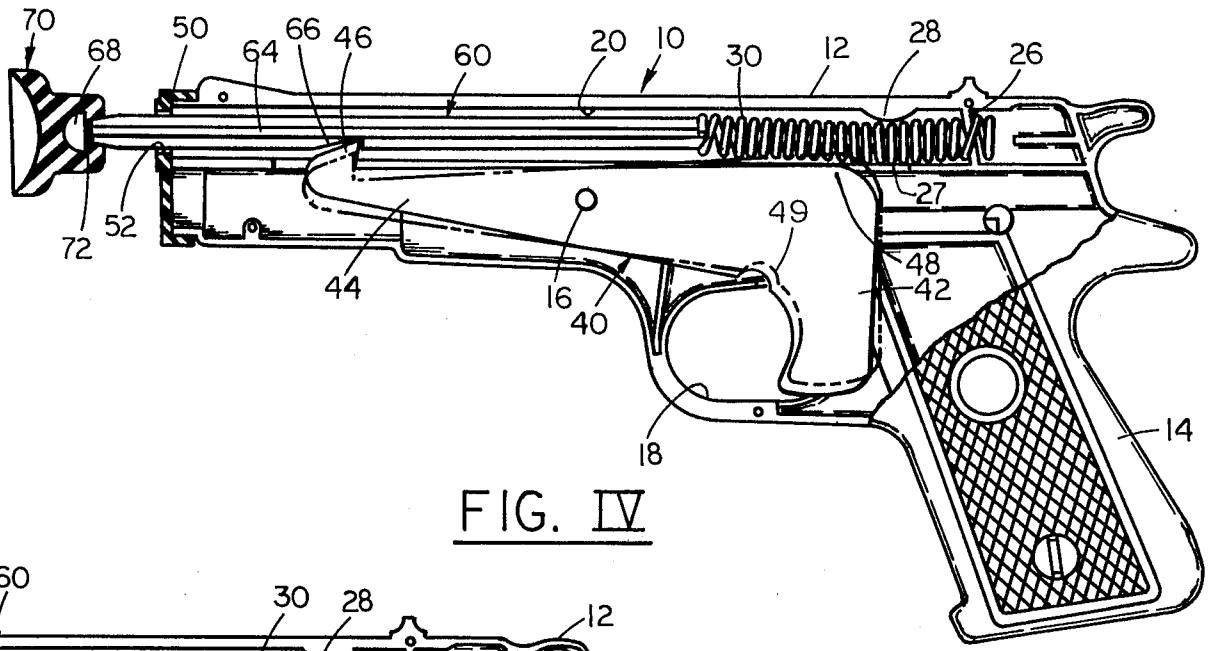
FIG. IV
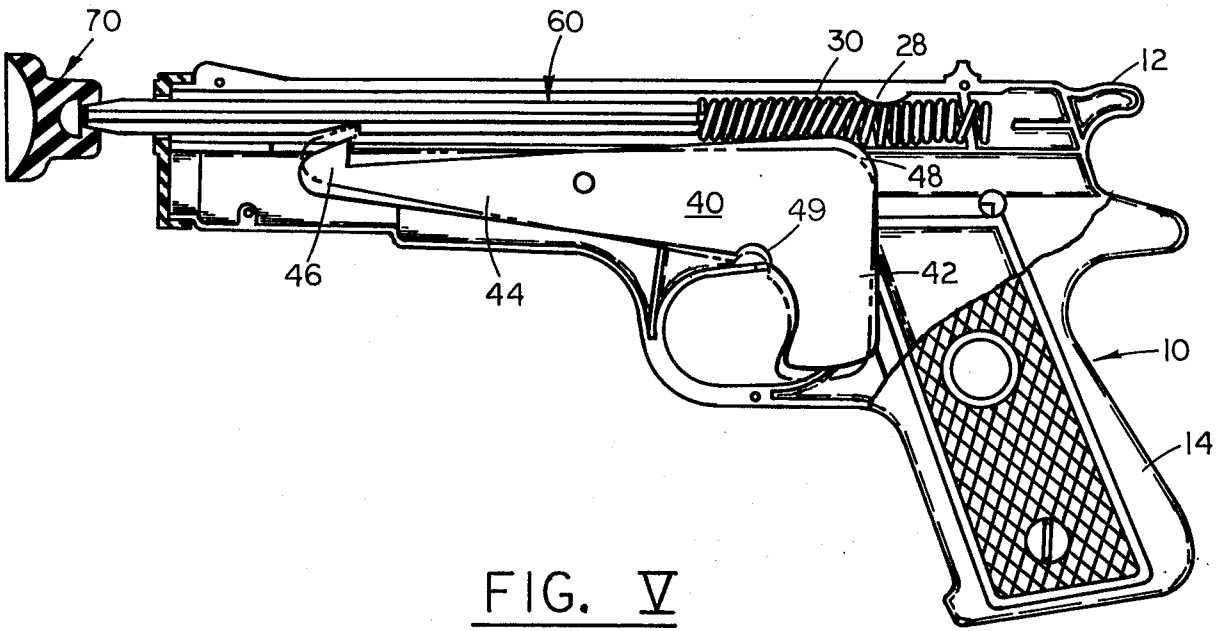
FIG. V

SPRING TYPE PROJECTILE PROJECTING DEVICE

SUMMARY OF THE INVENTION

Generally speaking a toy dart gun of this invention comprises: a plastic pistol shaped housing having a barrel that contains a compressible dart ejecting spring and a pivoted trigger means; and a dart for insertion into the barrel of this gun to cock the trigger and to be shot therefrom.

The pistol housing may comprise a pair of longitudinally complementary plastic molded hollow L-shaped pistol parts, each part forming half of the barrel and half of the handle of the gun. The open muzzle end of the barrel has a non-circular configuration aperture having radial projections which extend outwardly from the longitudinal axis of the barrel a greater distance than the inside diameter of the helical spring in the barrel so that the corresponding cooperating cross-section of the shaft of the dart will engage the compressible spring for compressing it, while other longitudinal objects that might be insertable in the central circular aperture of the muzzle housing would not so engage and compress the spring. The inside of the barrel may be correspondingly grooved and has a means at the inner or closed end thereof for holding and acting as a fixed reaction point for one end of the compressible ejecting spring.

One longitudinal side of the barrel is provided with a slit adjacent which is pivoted the longer leg of an L-shaped trigger lever that is pivoted centrally of this longer leg. The shorter leg of this trigger lever projects outwardly along the rear edge of the trigger finger guiding hole at the angle between the handle and barrel of the housing. The longer leg of this trigger lever or means adjacent the slot along the barrel, has a hook portion at its forward end projectable into the barrel, and has an abutment or spring side engaging portion at its other or rearward end, which also is alternately projectable into the barrel. Thus when the helical spring is compressed by the properly inserted dart that abuts the outer end of the compressible spring, the deflecting cam in the barrel substantially diametrically opposite the abutting end of the elongated trigger lever, causes the compressed spring to push against this abutting end of the trigger to rock the trigger lever around its pivot to insert the outer opposite hooked end of the trigger lever into engagement with a notch in and spaced away from the inner end of the shaft of the dart for cocking the gun. Thus, if a projectile can be inserted into the open end of the barrel of the gun and it does not have a notch in a predetermined position along the shaft of the dart opposite the hook of the trigger, it will not cock the gun, and any compression of the spring would immediately eject it.

In view of the specific internal structure of the barrel of the gun, the dart to be shot by this gun must have a corresponding and predetermined configuration. First the shaft of the dart must have a shaft of a cross-section complementary to the non-circular opening at the muzzle end of the gun so as to engage and compress the ejecting spring, or otherwise it would pass through the open cylindrical center of the spring, and secondly, its shaft must have a notch along one side thereof spaced from the inserted end of the shaft of the dart a predetermined distance in order to cooperate with the hook on the trigger when the compressible spring is properly and sufficiently compressed to cock the gun. This means that the side of the compressed ejecting spring must engage the inner end of the L-shaped trigger lever to urge the hook end of the trigger lever into the notch in the dart's shaft to hold the dart in the gun. Then when the dart is to be shot, the trigger is pulled to deform the compressed spring and withdraw the hook from the notch in the shaft, so that the compressed ejecting spring will eject the dart.

In order to insure that the dart at its outer end could not cause damage, a rubber suction cup with its concave surface outwardly is fixedly adhered to the outer end of the dart's shaft so as to be formed around a flange or nob at the end thereof, so that the dart cannot be readily changed or the rubber or flexible end removed without mutilating the dart.

Accordingly it is a purpose and object of this invention to produce an efficient, simple, effective, economic toy dart gun which cannot readily be changed into a dangerous weapon and which cannot shoot or be cocked by other objects than the particular darts designed therefor.

THE BRIEF DESCRIPTION OF THE VIEWS

The above mentioned and other features, objects and advantages, and a manner of obtaining them are described more specifically below by reference to an embodiment of this invention shown in the accompanying drawings wherein:

FIG. I is a side elevation of such a dart gun showing a dart therefor just being inserted in the open end of its barrel, parts of the housing broken away to show the compressible ejecting spring and trigger mechanism of the gun;

FIG. II is an enlarged muzzle end view of the gun taken along line II—II of FIG. I, showing the non-circular cross-sectional configurations of the shaft of the dart and the open muzzle end of the barrel into which the dart fits;

FIG. III is an enlarged sectional view of the barrel of the gun taken along line III—III of FIG. I, showing the dart removed and the dart guiding grooves at the muzzle end of the barrel;

FIG. IV is a view similar to FIG. I showing the gun cocked by the dart being in position ready for shooting, and in dotted lines the trigger in dart releasing position; and FIG. V is a view similar to FIG. IV showing the trigger in full lines in its dart releasing position distorting the compression spring; the cocked position of the trigger being shown in dotted lines as in FIG. IV.

DETAILED DESCRIPTION OF PREFERRED EMBODIMENT

In the figures, the pistol shaped toy dart gun 10 comprises herein a pair of complementary housing sections 12 and 14, most of the latter one of which is broken away to show the barrel 20 containing the helical compressible ejecting spring 30, and L-shaped trigger 40 pivoted for oscillation on the peg 16 along the side of the barrel 20. The shorter leg 42 of this trigger means 40 extends outwardly through a slot between the two housing members 12 and 14 into the trigger finger aperture 18 formed in these housings 12 and 14.

Over the outer end of the muzzle of the barrel 10 there may be provided a cap means 50 having a non-circular aperture 52 therein. The circular or center hole of this aperture has a smaller diameter than the inside diameter of the helical spring 30 so that any elongated cylindrical object which could be inserted into this central hole would not engage the end of the compression spring 30 to compress it from its position shown in FIG. I to that of FIG. IV. Thus the muzzle aperture 52 is provided with at least one radially extending notch 54 which may be tapered and which extends sufficiently outwardly from the central longitudinal axis of the barrel 20 and the spring 30 so as to expose longitudinally only a sufficient part of the outer end of the spring 30 to be engaged by the inner end of the proper or predetermined configured stem 62 of the dart 60. Furthermore the barrel 20 and the sides thereof may be provided with longitudinal grooves 22 for guiding the cooperating ribs 64, which also may be correspondingly tapered, if desired, and the dart stem 62 which cooperates and fits into the notches 54. Steps or abutment 24 may be located in the barrel 20 inside the muzzle end to engage the outer end of the spring to prevent it from falling out of the barrel, if the cap or muzzle cover 50 wouldn't. The inner end of the barrel 20 may be closed and/or contain web 26 which acts as stop or an abutment for the inner end of the spring 30. Along the inside of the barrel 20 adjacent the trigger 40 is provided a slot 27 at least the length of the longitudinal leg 44 of the trigger 40 so that either end of this leg may be oscillated around the pivot 16 for projection at least partially into the barrel chamber 20. Substantially diametrically opposite the inner end 48 of this leg 44 of the trigger means 40 is a deflecting means or cam 28 projecting radially into the barrel 20 to engage a side of the spring 30.

Referring specifically now to the longer leg 44 of the trigger means 40, there is provided at its outer end between the pivot 16 and the muzzle, a hook 46 for projection radially into the barrel 20 into engagement with a notch 66 in one side of the shaft 62 of the projectile or dart 60. The other or inner end of this leg 44 is provided with a slight abutment or cam portion 48, also but alternately projectable radially into the barrel 20 (see FIG. V). Thus compression of the spring 30 by insertion of the dart stem 62 urges the spring sideways by deflection from the cam 28 toward the trigger abutment 48 to rock the trigger lever 40 to urge its hook 46 into the barrel to insure engagement with the notch 66 when the dart is sufficiently inserted into the barrel so that the notch 66 is aligned with the hook 46, thus cocking the gun. In order to permit more movement of the trigger lever 40, it may have a cut-out portion 49 at its crotch to prevent contact with the adjacent edges of the trigger guide hole 18 thereby permitting the hook 46 further radial movement into the barrel and to insure better locking into the notch 66 in the dart shaft and thereby more positive cocking of the gun.

In order to shoot the gun, pressure on the trigger leg 42 by the operator's finger, will then put a double bend in the spring 30 as shown in FIG. V to remove the hook 46 from the notch 66 in the dart stem 62 releasing the dart for immediate ejection by the stored energy in the compression spring 30.

Referring now to the projectile or dart 60, it comprises a shaft 62 of non-circular cross-section herein cruciform, with two outwardly side or radially projecting ridges 64 which may be tapered and which cooperate with muzzle notches 54 and grooves 22 along opposite sides of the barrel 20, to insure that this shaped dart only can be inserted into the open muzzle end 52 of the dart gun 10 in a particular manner, and so that the notch 66 on one side thereof will be in alignment with hook 46 of trigger member 40. Although in the configuration shown it may be possible to insert the dart 60 upside-down or 180° from that shown in FIGS. I and IV and V, a cross-section configuration thereof can be made so that it can only be inserted the correct way. If the dart 60 shown were inserted upside -down, the gun could not be cocked and the dart would immediately be ejected and could not be held in the barrel 20. The outer end of the shaft 62 of the dart 60 has fixedly attached thereto a rubber or other soft resilient plastic nob, such as a suction cup 70, which preferably is also adhered by an adhesive 72 as well as being formed or molded around the flanged end 68 of the shaft 62.

The simplicity of this design and the relatively few parts thereof, produce a toy pistol which can not be used for shooting objects or projectiles which are not designed or supposed to be shot therefrom. For example, the tapered notches 54 in the muzzle cap 50 prevent the rectangle cross-section of lollipop sticks from being inserted into the gun barrel 20. Furthermore, no special catches or devices are provided inside the barrel 20 to permit cocking of the ejector spring in the gun except by the proper dart therefor, even if the dart 60 is inserted 180° from its proper position. Furthermore it is important that the notch 66 along the shaft 62 of the dart or projectile 60 corresponds with the location of the hook 46, so that any notch or flange elsewhere along or at the end of the shaft of a projectile will not permit cocking of the gun, even if it could compress the spring 30. Thus there are several elements and features of the dart gun of this invention that must cooperate simultaneously in order that this dart gun can be operated or shot.

While there is described above the principles of this invention in connection with specific apparatus, it is to be clearly understood that this description is made only by way of example and not as a limitation to the scope of this invention.

I claim:

1. In a dart gun comprising a barrel having an outer open end and a closed inner end, a helical compression spring in said barrel engaging said closed inner end, and a projectile having a shank with a notch therealong and being insertable in said open outer end of said barrel for compressing said spring, the improvement comprising:

A. a trigger means for holding and releasing said projectile having a longitudinal portion extending along said barrel intermediate the ends thereof, and being pivoted intermediate said longitudinal portion adjacent said barrel, said longitudinal portion having a hook at one end engageable with said notch in said projectile and an abutment at its other and engageable with the side of said spring, and B. a deflector means in said barrel opposite said abutment on said trigger means for urging the lateral side of said spring towards said abutment on said trigger means to urge said hook into engagement with said notch.

2. A dart gun according to claim 1 wherein the outer open end of said barrel has a configuration with at least one radial notch portion which extends beyond the inside diameter of said helical spring, and wherein the shank of said projectile has a corresponding matchable cross-sectional configuration.

3. A dart gun according to claim 2 wherein said notch portion has tapered sides.

4. A dart gun according to claim 3 wherein said projectile has a longitudinal ridge with tapered sides corresponding in cross-section to the tapered sides of said notch portion.

5. A dart gun according to claim 2 wherein said barrel has a longitudinal groove corresponding to said notch portion.

6. A dart gun according to claim 1 wherein said projectile has an outwardly concave suction cup adhered to the end of said shank which remains outside the barrel of said gun.

7. A dart gun according to claim 1 wherein said deflector means in said barrel comprises a convex shaped ridge radially extending partly toward the longitudinal axis of said barrel.

8. A dart gun according to claim 1 wherein said trigger means has an L-shaped configuration in which the longitudinal portion comprises the longer leg of the L and the shorter leg of the L comprises a trigger finger portion.

* * * * *

(5/69)

UNITED STATES PATENT OFFICE
CERTIFICATE OF CORRECTION

Patent No. 3,968,784 Dated July 13, 1976

Inventor(s) Larry E. MILLER

It is certified that error appears in the above-identified patent and that said Letters Patent are hereby corrected as shown below:

| | |
|---|---|
| In the Abstract, lines 10 - 11 | change "engagable" to - - engageable - - |
| In the Abstract, line 13 | change "engagable" to - - engageable - - |
| In the Abstract, line 15 | change "engagable" to - - engageable - - |
| Column 3, line 22 | before "web" insert - - a - - |
| Column 4, line 55 | change "and" (first occurrence) to - - end - - |

Signed and Sealed this

Second Day of November 1976

[SEAL]

*Attest:*

RUTH C. MASON
*Attesting Officer*

C. MARSHALL DANN
*Commissioner of Patents and Trademarks*